US008313884B2

(12) United States Patent
Nosella et al.

(10) Patent No.: US 8,313,884 B2
(45) Date of Patent: Nov. 20, 2012

(54) TONER PROCESSES UTILIZING A DEFOAMER AS A COALESCENCE AID FOR CONTINUOUS AND BATCH EMULSION AGGREGATION

(75) Inventors: Kimberly D. Nosella, Mississauga (CA); Allan K. Chen, Oakville (CA); Zhen Lai, Webster, NY (US); Zhaoyang Ou, Webster, NY (US); Daryl W. Vanbesien, Burlington (CA)

(73) Assignee: Xerox Corporation, Norwalk, CT (US)

( * ) Notice: Subject to any disclaimer, the term of this patent is extended or adjusted under 35 U.S.C. 154(b) by 253 days.

(21) Appl. No.: 12/835,983

(22) Filed: Jul. 14, 2010

(65) Prior Publication Data

US 2010/0310984 A1 Dec. 9, 2010

Related U.S. Application Data

(63) Continuation-in-part of application No. 12/478,855, filed on Jun. 5, 2009.

(51) Int. Cl.
*G03G 5/00* (2006.01)

(52) U.S. Cl. ..... 430/137.14; 430/108.1

(58) Field of Classification Search ..... 430/137.14, 430/108.1

See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,933,954 | A | 1/1976 | Gebhard et al. |
| 4,056,653 | A | 11/1977 | Gebhard et al. |
| 4,298,672 | A | 11/1981 | Lu |
| 4,338,390 | A | 7/1982 | Lu |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,354,804 | A | 10/1994 | Inada et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,399,597 | A | 3/1995 | Mandel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,548,004 | A | 8/1996 | Mandel et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,977,210 | A | 11/1999 | Patel et al. |
| 5,994,020 | A | 11/1999 | Patel et al. |
| 6,063,827 | A | 5/2000 | Sacripante et al. |
| 6,080,807 | A | 6/2000 | Campbell |
| 6,214,507 | B1 | 4/2001 | Sokol et al. |
| 6,512,024 | B1 | 1/2003 | Lundgard et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,064,156 | B2 | 6/2006 | Rink et al. |
| 7,385,001 | B2 | 6/2008 | Shim et al. |
| 7,452,646 | B2 | 11/2008 | Hu et al. |
| 2002/0074681 | A1 | 6/2002 | Lundgard et al. |
| 2006/0222991 | A1 | 10/2006 | Sacripante et al. |
| 2007/0088117 | A1 | 4/2007 | Zhou et al. |
| 2008/0107989 | A1 | 5/2008 | Sacripante et al. |
| 2008/0153027 | A1 | 6/2008 | Veregin et al. |
| 2009/0130578 | A1* | 5/2009 | Sensui ..... 430/105 |
| 2009/0208864 | A1 | 8/2009 | Zhou et al. |
| 2009/0246680 | A1 | 10/2009 | Chung et al. |

FOREIGN PATENT DOCUMENTS

| | | |
|---|---|---|
| WO | WO 98/45356 | 10/1998 |
| WO | WO 00/17256 | 3/2000 |

OTHER PUBLICATIONS

U.S. Appl. No. 12/488,058.
U.S. Appl. No. 12/478,855.

* cited by examiner

*Primary Examiner* — Mark A Chapman
(74) *Attorney, Agent, or Firm* — Judith L. Byorick

(57) ABSTRACT

A process for making toner particles is provided. In embodiments, a suitable process includes adding a defoamer to an emulsion utilized to form toner particles. Utilization of the defoamer allows for a reduction in the overall aggregation/coalescence cycle time and slurry viscosity, while producing a toner with improved GSDs, low coarse and target circularities.

20 Claims, No Drawings

TONER PROCESSES UTILIZING A DEFOAMER AS A COALESCENCE AID FOR CONTINUOUS AND BATCH EMULSION AGGREGATION

CROSS REFERENCE TO RELATED APPLICATIONS

This application is a continuation-in-part of co-pending U.S. patent application Ser. No. 12/478,855, filed on Jun. 5, 2009, the disclosure of which is hereby incorporated by reference in its entirety.

TECHNICAL FIELD

The present disclosure relates to processes for producing toners suitable for electrophotographic apparatuses. More specifically, the present disclosure relates to processes and toners utilizing a defoamer as a coalescence aid.

BACKGROUND

Numerous processes are within the purview of those skilled in the art for the preparation of toners. Emulsion aggregation (EA) is one such method. EA toners may be used in forming print and/or xerographic images. EA techniques may involve the formation of an emulsion latex of the resin particles by heating the resin using a batch or semi-continuous emulsion polymerization, as disclosed in, for example, U.S. Pat. No. 5,853,943, the disclosure of which is hereby incorporated by reference in its entirety. Other examples of emulsion/aggregation/coalescing processes for the preparation of toners are illustrated in U.S. Pat. Nos. 5,902,710; 5,910,387; 5,916,725; 5,919,595; 5,925,488, 5,977,210, 5,994,020, and U.S. Patent Application Publication No. 2008/01017989, the disclosures of each of which are hereby incorporated by reference in their entirety.

EA toner processes include coagulating a combination of emulsions, i.e., emulsions including a latex, wax, pigment, and the like, with a flocculent such as polyaluminum chloride and/or aluminum sulfate, to generate a slurry of primary aggregates which then undergo a controlled aggregation process. However, a batch process may take from about 7 to about 10 hours. In addition, excess foam during wet sieving creates an aggregation/coalescence bottleneck problem. Defoamers have been utilized in the phase inversion process to reduce solvent stripping time, as illustrated, for example, in U.S. patent application Ser. No. 12/488,058, the disclosure of which is hereby incorporated by reference in its entirety. However, the defoamer is largely removed from the latex emulsion during the solvent stripping process.

Improved methods for producing toners having low coarse content, which reduce the number of stages, cycle times, and materials, remain desirable. Such processes may reduce production costs for such toners and may be environmentally friendly.

SUMMARY

A method for producing toner is provided which includes contacting at least one resin with at least one surfactant, an optional wax, an optional colorant, and at least one defoamer to form a primary slurry; aggregating the at least one resin with an aggregating agent to form aggregated particles; coalescing the aggregated particles to form toner particles; and recovering the toner particles, wherein coalescence cycle time is from about 1 minute to about 2 hours.

A method for producing toner is provided which includes contacting at least one amorphous polyester resin with at least one crystalline polyester resin, at least one surfactant, an optional wax, an optional colorant, and at least one defoamer to form a primary slurry; aggregating the at least one amorphous polyester resin in combination with at least one crystalline polyester resin with an aggregating agent to form aggregated particles; coalescing the aggregated particles to form toner particles; and recovering the toner particles, wherein the aggregation/coalescence time is from about 5 hours to about 15 hours.

A method for producing toner of the present disclosure includes contacting at least one amorphous polyester resin with at least one crystalline polyester resin, at least one surfactant, an optional wax, an optional colorant, and at least one defoamer selected from the group consisting of ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, fumed silica, and combinations thereof, in an amount of from about 0.01% to about 5% to form a primary slurry; aggregating the at least one amorphous polyester resin in combination with at least one crystalline polyester resin with an aggregating agent to form aggregated particles; coalescing the aggregated particles to form toner particles; and recovering the toner particles, wherein coalescence cycle time is from about 1 minute to about 120 minutes.

DETAILED DESCRIPTION

The present disclosure provides processes for producing toner particles. In embodiments, a process of the present disclosure includes the use of a defoamer, sometimes also referred to as an anti-foam agent, to reduce the overall aggregation/coalescence cycle time in an EA toner process. The process of the present disclosure is thus more efficient. The EA process of the present disclosure utilizing the defoamer is also environmentally friendly, as particles may spherodize more quickly than prior EA processes. In addition, utilization of the defoamer may provide toner particles with improved geometric size distribution (GSD), low coarse content, and reduced cycle time to achieve target circularities. Foaming may also be reduced during wet sieving and other downstream processes, by helping the toner slurry flow better, improving the overall toner production cycle time and product yield even further.

Resins

Any resin may be utilized in the processes of the present disclosure. Such resins, in turn, may be made of any suitable monomer or monomers via any suitable polymerization method. In embodiments, the resin may be prepared by a method other than emulsion polymerization. In further embodiments, the resin may be prepared by condensation polymerization.

In embodiments, the resin may be a polyester, polyimide, polyolefin, polyamide, polycarbonate, epoxy resin, and/or copolymers thereof. In embodiments, the resin may be an amorphous resin, a crystalline resin, and/or a mixture of crystalline and amorphous resins.

In embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent, and a second diacid can be selected in an amount of from about 0 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), and copoly (ethylene-fumarate)-copoly(ethylene-dodecanoate). The crystalline resin may be present, for example, in an amount of from about 5 to about 50 percent by weight of the toner components, in embodiments from about 10 to about 35 percent by weight of the toner components.

The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, polycondensation catalysts may be used in forming the polyesters. Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly (butyloxylated bisphenol co-fumarate), poly(co-propoxylated bisphenol co-ethoxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

The amorphous resin can possess various glass transition temperatures (Tg) of, for example, from about 40° C. to about 100° C., in embodiments from about 50° C. to about 70° C.

In embodiments, a suitable amorphous polyester resin may be a poly(propoxylated bisphenol A co-fumarate) resin having the following formula (I):

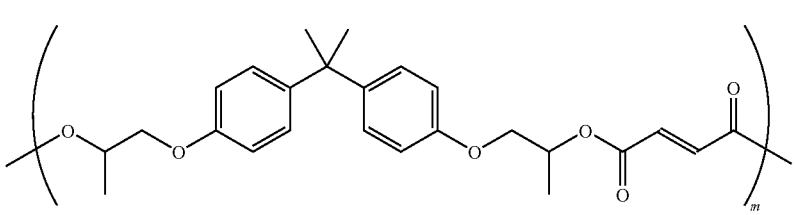

(I)

wherein m may be from about 5 to about 1000, in embodiments from about 10 to about 500, in other embodiments from about 15 to about 200. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a toner resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Suitable crystalline resins which may be utilized, optionally in combination with an amorphous resin as descried above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

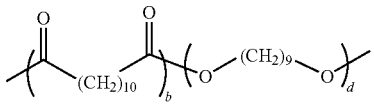

(II)

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a resin suitable for forming a toner.

In embodiments, the processes of the present disclosure may be utilized to form ultra low melt (ULM) polyester toners.

Examples of other suitable toner resins or polymers which may be utilized include those based upon styrenes, acrylates, methacrylates, butadienes, isoprenes, acrylic acids, methacrylic acids, acrylonitriles, and combinations thereof. Exemplary additional resins or polymers include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

The amorphous resin may be present, for example, in an amount of from about 10 to about 90 percent by weight of the toner components, in embodiments from about 30 to about 80 percent by weight of the toner components.

In embodiments, the resins may include polyester resins having a glass transition temperature of from about 30° C. to about 80° C., in embodiments from about 35° C. to about 70° C. In further embodiments, the resins utilized in the toner may have a melt viscosity of from about 10 to about 1,000,000 Pa·S at about 130° C., in embodiments from about 20 to about 100,000 Pa·S.

One, two, or more toner resins may be used. In embodiments, where two or more resins are used, the resins may be in any suitable ratio (e.g., weight ratio) such as for instance of from about 1% (first resin)/99% (second resin) to about 99% (first resin)/1% (second resin), in embodiments from about 10% (first resin)/90% (second resin) to about 90% (first resin)/10% (second resin), Where the resin includes an amorphous resin and a crystalline resin, the weight ratio of the two resins may be from about 99% (amorphous resin): 1% (crystalline resin), to about 1% (amorphous resin): 90% (crystalline resin).

In embodiments the resin may possess acid groups which, in embodiments, may be present at the terminal of the resin. Acid groups which may be present include carboxylic acid groups, and the like. The number of carboxylic acid groups may be controlled by adjusting the materials utilized to form the resin and reaction conditions.

In embodiments, the resin may be a polyester resin having an acid number from about 2 mg KOH/g of resin to about 200 mg KOH/g of resin, in embodiments from about 5 mg KOH/g of resin to about 50 mg KOH/g of resin. The acid containing resin may be dissolved in tetrahydrofuran solution. The acid number may be detected by titration with KOH/methanol solution containing phenolphthalein as the indicator. The acid number may then be calculated based on the equivalent amount of KOH/methanol required to neutralize all the acid groups on the resin identified as the end point of the titration.

In embodiments, a latex emulsion may be formed by emulsion aggregation methods. Utilizing such methods, the resin may be present in a resin emulsion, which may then be combined with other components and additives to form a toner of the present disclosure.

Toner

The emulsions as described above may be utilized to form toner compositions by any method within the purview of those skilled in the art. The latex emulsion may be contacted with a colorant, optionally in a dispersion, a defoamer, and other additives to form a toner by a suitable process, in embodiments, an emulsion aggregation and coalescence process.

In embodiments, the optional additional ingredients of a toner composition including colorant, wax, and other additives may be added before, during or after the melt mixing the resin to form the latex. The additional ingredients may be added before, during or after the formation of the latex emulsion, wherein the neutralized resin is contacted with water. In further embodiments, the colorant may be added before the addition of the surfactant.

Surfactants

In embodiments, resins, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be added as a solid or as a highly concentrated solution with a concentration of from about 10% to about 100% (pure surfactant) by weight, in embodiments, from about 15% to about 75% by weight.

In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108. Combinations of these surfactants and any of the foregoing nonionic surfactants may be utilized in embodiments.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Anti-foam Agent/Defoamer

In embodiments, the process of the present disclosure may include adding an anti-foam agent or defoamer to the resin emulsions. Defoamers of the present disclosure may reduce the overall aggregation/coalescence cycle time in the EA toner process and may provide toner particles with improved GSDs, i.e., number average Geometric Size Distribution (GSDn) and/or volume average Geometric Size Distribution (GSDv), low coarse content, and target circularities. Foaming may also be reduced during wet sieving and other downstream processes improving the cycle time and product yield even further.

In embodiments, the anti-foam agent may be added to an emulsion, in embodiments a mixture of emulsions utilized to form toner particles, before the emulsions are coagulated with an aggregating agent to form a slurry of primary particles ("primary slurry"). In embodiments, the anti-foam agent may be added in amounts of from about 0.1 ppm to about 10,000 ppm based on dry toner weight, in embodiments from about 1 ppm to about 2,000 ppm based on dry toner weight.

Suitable defoamers include, for example, polyols, sometimes referred to herein as polyhydric alcohols, having the general formula $H(HCHO)_{n+1}H$, where n is from about 1 to about 20, in embodiments from about 2 to about 10. Exemplary polyols which may be used as a defoamer include, but are not limited to, ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, combinations thereof, and the like.

In embodiments, upon mixing with aqueous solutions, the defoamer may form small droplets and spontaneously spread over aqueous films at the air/water interface of bubbles (part of the foam). The defoamer droplets quickly spread over the film layer and, coupled with strong de-wetting actions, thin out the film layer, causing the film to rupture. To facilitate such film rupture, micron-sized hydrophobic fumed silica particles may often be added to a defoamer formulation. Hydrophobic silica particles may congregate in the air/water interface along with the oil droplets. As the film layer thins out by spreading oil droplets, sharp irregular silica particles may help pierce the film and the foam as a whole. In embodiments, the combination of a polyol, such as for example, polypropylene glycol, and fumed silica may thus reduce slurry viscosity and the overall aggregation/coalescence time for making an EA toner.

In embodiments, defoamers may be made of highly hydrophobic substances, for example, mineral and silicone oils. Suitable anti-foam agents which may be utilized for the processes and toners of the present disclosure may include any liquid hydrocarbon byproducts of petroleum such as for example, mineral oil.

In embodiments, an anti-foam agent may include, for example, TEGO® FOAMEX 830, commercially available from Evonik Co, which includes mineral-oil with dispersed micron-sized silica particles having their surfaces modified with hydrophobic polyether molecules.

In embodiments, suitable anti-foam agents which may be utilized may include hydrogenated and non-hydrogenated vegetable oils extracted from plants, including coconut oil, corn oil, cottonseed oil, olive oil, palm oil, rapeseed oil, almond oil, cashew oil, hazelnut oil, macadamia oil, mongongo oil, pine nut oil, pistachio oil, walnut oil, bottle gourd oil, buffalo gourd oil, pumpkin seed oil, watermelon seed oil, acai oil, blackcurrant seed oil, borage seed oil, evening primrose oil, carob pod oil, amaranth oil, apricot oil, apple seed oil, argan oil, artichoke oil, avocado oil, babassu oil, ben oil, borneo tallow nut oil, cape chestnut oil, cocoa butter, algaroba oil, cocklebur oil, poppyseed oil, cohune oil, dika oil, false flax oil, flax seed oil, grape seed oil, hemp oil, kapok seed oil, lallemantia oil, manila oil, meadowfoam seed oil, mustard oil, nutmeg butter, nutmeg oil, okra seed oil (hibiscus seed oil), papaya seed oil, perilla seed oil, pequi oil, pine nut oil, poppyseed oil, prune kernel oil, quinoa oil, ramtil oil, rice bran oil, royle oil, sacha inchi oil, tea oil (camellia oil), thistle oil, tomato seed oil, and wheat germ oil, combinations thereof, and the like.

In embodiments, suitable anti-foam agents or defoamers which may be utilized for the processes and toners of the present disclosure include low-molecular-weight oligometric-type hydrophobic homo- and co-polymers made of ethers, vinyl ethers, esters, vinyl esters, ketones, vinylpyridine, vinypyrrolidone, fluorocarbons, amides and imides, vinyllidene chlorides, styrenes, carbonates, vinyl acetals and acrylics, combinations thereof, and the like.

Such defoamers may enable high solid loadings in the primary slurry, while maintaining good flow and desirable size distribution of primary aggregates.

Utilizing a defoamer as described herein, the solids content of the emulsion may thus be from about 20% to about 50%, in embodiments from about 30% to about 45% of the emulsion.

The viscosity of the primary slurry may be strongly reduced in the presence of the defoamer, such as polypropylene glycol in combination with fumed silica. For example, the viscosity of the primary slurry may be from about 1 cps to about 100 cps, in embodiments from about 5 cps to about 80 cps. Adequate mixing of the primary slurry, may thus be obtained without having to resort to powerful mixing equipment. Also, due to its high water solubility, the defoamer, in embodiments polypropylene glycol and fumed silica, may be present mostly in the water phase of the slurry and thus does not remain in washed and dried toners, thereby minimizing its potential effect on toner properties.

The amount of anti-foam agent present in the toner particles is, in embodiments, from about 0.01 percent by weight of the toner particles to about 10 percent by weight of the toner particles, in embodiments, from about 0.1 percent by weight of the toner particles to about 5 percent by weight of the toner particles.

Colorants

As the colorant to be added, various known suitable colorants, such as dyes, pigments, mixtures of dyes, mixtures of pigments, mixtures of dyes and pigments, and the like, may be included in the toner. In embodiments, the colorant may be included in the toner in an amount of, for example, about 0.1 to about 35% by weight of the toner, or from about 1 to about 15% by weight of the toner, or from about 3 to about 10% by weight of the toner.

As examples of suitable colorants, mention may be made of carbon black like REGAL 330® (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850: 1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In embodiments, the colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will become readily apparent based on the present disclosures.

Wax

Optionally, a wax may also be combined with the resin and optional colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1 weight percent to about 25 weight percent of the toner particles, in embodiments from about 5 weight percent to about 20 weight percent of the toner particles.

When a wax dispersion is used, the wax dispersion may include any of the various waxes conventionally used in emulsion aggregation toner compositions. Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 300 nm.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, the present disclosure provides processes for producing toner particles with an anti-foam agent having a more efficient aggregation/coalescence cycle time. In embodiments, a process of the present disclosure may include contacting at least one resin with at least one surfactant to form an emulsion; contacting the emulsion with an optional wax, an optional colorant, and at least one defoamer to form a primary slurry; aggregating the at least one resin with an aggregating agent to form aggregated particles; coalescing the aggregated particles to form toner particles; and recovering the toner particles.

In embodiments, the optional additional ingredients of a toner composition including colorant, wax, and other additives may be added before, during or after preparing the resin emulsion. The additional ingredients can be added before, during or after the addition of the optional surfactant. In further embodiments, the colorant may be added before the addition of the optional surfactant.

Toner-sized" indicates that the droplets have a size comparable to toner particles used in xerographic printers and copiers, wherein "toner sized" in embodiments indicates a volume average diameter of, for example, from about 2 μm to about 25 μm, in embodiments from about 3 μm to about 15 μm, in other embodiments from about 4 μm to about 10 μm. As it may be difficult to directly measure droplet size in the emulsion, the droplet size in the emulsion may be determined by solidifying the toner-sized droplets and then measuring the resulting toner particles.

Because the droplets may be toner-sized in the disperse phase of the phase inversed emulsion, in embodiments there may be no need to aggregate the droplets to increase the size thereof prior to solidifying the droplets to result in toner particles. However, such aggregation/coalescence of the droplets is optional and can be employed in embodiments of the present disclosure, including the aggregation/coalescence techniques described in, for example, U.S. Patent Application Publication No. 2007/0088117, the disclosure of which is hereby incorporated by reference in its entirety.

In embodiments, toner compositions may be prepared by emulsion-aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 3,000 to about 5,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, and the like, and mixtures thereof.

Other suitable aggregating agents also include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the aggregating agent is a polyion aggregating agent, the agent may have any desired number of polyion atoms present. For example, in embodiments, suitable polyaluminum compounds have from about 2 to about 13, in other embodiments, from about 3 to about 8, aluminum ions present in the compound.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

The particles may be permitted to aggregate until a predetermined desired particle size is obtained and at a temperature that is below the glass transition temperature of the resin as discussed above, in embodiments from about 30° C. to about 90° C., in embodiments from about 35° C. to about 70° C. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 30° C. to about 99° C., and holding the mixture at this temperature for a time from about 0.5 hours to about 10 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a shell may be applied to the aggregated particles. Any resin described above as suitable for forming the core resin may be utilized as the shell. In embodiments, a polyester amorphous resin latex as described above may be included in the shell.

In embodiments, resins which may be utilized to form a shell include, but are not limited to, a crystalline resin latex described above, and/or the amorphous resins described above that may be formed by for example, a phase inversion emulsification process. In embodiments, an amorphous resin which may be utilized to form a shell in accordance with the present disclosure includes an amorphous polyester, optionally in combination with a crystalline polyester resin latex described above. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

The shell resin may be applied to the aggregated particles by any method within the purview of those skilled in the art. In embodiments, the resins utilized to form the shell may be in an emulsion including any surfactant described above. The emulsion possessing the resins may be combined with the aggregated particles described above so that the shell forms over the aggregated particles.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

Coalescence

Following aggregation to the desired particle size and application of an optional shell resin described above, the particles may then be coalesced to the desired final shape, the coalescence being achieved by, for example, heating the mixture to a suitable temperature. This temperature may, in embodiments, be from about 40° C. to about 99° C., in embodiments from about 50° C. to about 95° C. Higher or lower temperatures may be used, it being understood that the temperature is a function of the resins used.

Coalescence may be accomplished over a period of from about 1 minute to about 24 hours, in embodiments from about 5 minutes to about 10 hours.

In accordance with the present disclosure, the coalescence cycle time is reduced from about 10% to about 80%, in embodiments from about 20% to about 70%, compared with the time utilized in the absence of the defoamer as described above. In embodiments, the overall aggregation/coalescence time is reduced from about 5% to about 30%, in embodiments from about 10% to about 25% compared with the time utilized in the absence of the defoamer as described above.

In embodiments, the time for coalescence may be from about 1 minute to about 2 hours, in embodiments from about 20 minutes to about 60 minutes, with the overall aggregation/coalescence time being from about 5 hours to about 15 hours, in embodiments from about 6 hours to about 10 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

In accordance with the present disclosure, most of the defoamer, in embodiments polypropylene glycol, may be removed during the washing process due to its strong affinity to water. The defoamer may be selected so that is poses no additional environmental handling requirement since it generally may be non-toxic and decomposes biologically in waste water treatment process.

Additives

In embodiments, the toner particles may also contain other optional additives, as desired or required. For example, the toner may include positive or negative charge control agents, for example in an amount of from about 0.1 to about 10% by weight of the toner, in embodiments from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like.

There can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, calcium stearates, aluminum oxides, cerium oxides, or long chain acids such as UNILIN 700, and mixtures thereof.

In general, silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1 percent by weight to about 5 percent by weight of the toner, in embodiments of from about 0.25 percent by weight to about 3 percent by weight of the toner. In embodiments, the toners may include, for example, from about 0.1% by weight to about 5% by weight titania, from about 0.1% by weight to about 8% by weight silica, and from about 0.1% by weight to about 4% by weight zinc stearate.

Suitable additives include those disclosed in U.S. Pat. Nos. 3,590,000, 3,800,588, 6,214,507, and 7,452,646 the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a shell of the present disclosure may, exclusive of external surface additives, have the following characteristics:

(1) Volume average diameter (also referred to as "volume average particle diameter") of from about 3 to about 25 μm, in embodiments from about 4 to about 15 μm, in other embodiments from about 4.5 to about 10 μm.

(2) Number Average Geometric Size Distribution (GSDn) and/or Volume Average Geometric Size Distribution (GSDv) of from about 1.05 to about 1.55, in embodiments from about 1.1 to about 1.4.

(3) Circularity of from about 0.93 to about 1, in embodiments from about 0.95 to about 0.99.

(4) Coarse content of from about 0.01% to about 10%, in embodiments, of from about 0.1% to about 5%.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. The GSDv refers to the upper geometric standard deviation (GSDv) by volume (coarse level) for (D84/D50). The GSDn refers to the geometric standard deviation (GSDn) by number (fines level) for (D50/D16). The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution.

Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

The circularity of the toner particles may be determined by any suitable technique and apparatus. The circularity is a measure of the particles closeness to perfectly spherical. A circularity of 1.0 identifies a particle having the shape of a perfect circular sphere. Volume average circularity may be measured by means of a measuring instrument such as a Flow Particle Image Analysis (FPIA) such as for example the Sysmex® Flow Particle Image Analyzer, commercially available from Sysmex Corporation, operated in accordance with the manufacturer's instructions. Representative sampling may occur as follows: about 0.5 grams of toner sample may be obtained and filtered through a 25 micrometer screen, then put in deionized water to obtain a concentration of about 5%, with the sample then run in a Flow Particle Image Analyzer.

The coarse content of the toner particles may be determined by any suitable technique and apparatus. Coarse content may be measured by means of wet sieving using a sieve and collecting the coarse or a measuring instrument such as a coulter counter, such as the Beckman Coulter Counter Multisizer 3, commercially available from Beckman Coulter, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Comparative Example 1

An emulsion aggregation polyester toner with no defoamer was prepared at a 2 liter (2L) Bench scale (about 165 grams of dry theoretical toner). About 110 grams of a linear amorphous resin, referred to herein as resin A in an emulsion (about 38 weight % resin) and about 111 grams of a linear amorphous resin, referred to herein as resin B in an emulsion (about 37 weight % resin), about 34 grams of a crystalline polyester emulsion, about 5.06 grams of surfactant (i.e., DOWFAX®, commercially available from the Dow Chemical Company), about 58 grams of a cyan pigment, Pigment Blue 15:3 in a dispersion (about 17 weight %), and about 51 grams of a paraffin wax (about 30 weight %) (commercially available from The International Group, Inc.), were added to a plastic beaker and mixed. The pH of the mixture was adjusted to about 4.2 by adding about 22 grams of nitric acid (about 0.3M). About 2.96 grams of $Al_2(SO_4)_3$ (about 27.8 weight %) mixed with about 36.5 grams of deionized water was added to the slurry as a flocculent under homogenization at a speed of from about 3000 rpm to about 4000 rpm for about 5 minutes. The slurry was then transferred to a 2L Buchi reactor.

The mixture was subsequently heated to about 42° C. for aggregation while mixing at a speed of about 460 rpm.

When the particle size reached a certain value, for example about 5 μm, a mixture of about 60 grams of the same linear amorphous resin A in an emulsion described above (about 38 weight % resin) and about 61 grams of the same linear amorphous resin B in an emulsion described above (about 37 weight % resin) were added to the reactor to form a shell over the aggregated particles. The batch was further heated at about 45° C. to achieve the desired particle size. The pH of the mixture was adjusted to about 5 by adding about 11.4 grams of pH 9 Tris-HCL buffer, sodium hydroxide, and EDTA. Once at the target particle size of about 5.5 microns was obtained (i.e. after about 1 hour), the aggregation step was frozen.

The reactor temperature was then increased to about 85° C. and the pH was adjusted to about 6.5 using pH 5.7 sodium acetate/acetic acid buffer, so that the particles began to coalesce. After about two hours, the particles achieved >0.965 circularity as determined by FPIA, and were cooled.

The particle size was monitored with a Coulter Counter and the Geometric Size Distribution ("GSD") was determined. The final toner particle size, $GSD_v$, and $GSD_n$ were about 5.48 μm, about 1.21, and about 1.24, respectively. The fines (about 1-4 microns), coarse (about >16 microns), and circularity of the resulting particles were about 18.63%, about 0.2% and about 0.969, respectively.

Table 1 below includes a summary of the cycle times for this control toner in comparison with the toners prepared in accordance with the present disclosure.

Example 1

An emulsion aggregation polyester toner with about 140 parts per million (ppm) defoamer was prepared following the synthesis described in Comparative Example 1 above, utilizing the same components in the same amounts and concentrations. The difference between this Example and Comparative Example 1 above was that about 0.02 grams of a defoamer, TEGO® FOAMEX 830, commercially available from Special Chem S.A.) was also added to the plastic beaker followed by mixing and pH adjustment to 4.2 using 21 gram of 0.3M HNO3 acid.

Aggregation of the particles proceeded, a shell was added thereto, and coalescence of the particles occurred as described above in Comparative Example 1.

After the aggregation/coalescence of the particles as described above in Comparative Example 1, the reactor temperature was then increased to 85° C. and the pH was adjusted to about 6.5 using pH 5.7 sodium acetate/acetic acid buffer where the particles began to coalesce. After about one hour, the particles achieved >0.965 circularity and were cooled.

The particle size was monitored with a Coulter Counter and the GSD was determined. The final toner particle size, $GSD_v$, and $GSD_n$ were about 5.31 μm, about 1.19, and about 1.23, respectively. The fines (about 1-4 microns), coarse (about >16 microns), and circularity, were about 18.80%, about 0.08% and about 0.977, respectively.

Table 1 below includes a summary of the cycle times for the control toner of Comparative Example 1 compared with the toner of this Example 1.

Example 2

An emulsion aggregation polyester toner with about 500 ppm defoamer was prepared as described above in Example 1, with the only difference between this Example 2 and Example 1 being that about 0.072 grams of defoamer (TEGO® FOAMEX 830, commercially available from Special Chem S.A.) was added.

The same shell was added, with aggregation and coalescence proceeding as set forth in Example 1 until the particles achieved >0.965 circularity and were cooled.

The particle size was monitored with a Coulter Counter and the GSD was determined. The final toner particle size, $GSD_v$, and $GSD_n$ were about 5.60 μm, about 1.20, and about 1.21, respectively. The fines (about 1-4 microns), coarse (about >16 microns), and circularity were about 12.54%, about 0.25% and about 0.983, respectively.

Table 1 below includes a summary of the cycle times for the above toners.

TABLE 1

| | Defoamer | Coalescence Time | Toner Circularity | Overall Cycle Time |
|---|---|---|---|---|
| Comparative Example 1 (Control) | 0 | 2 hrs | 0.968 | 5 hrs |
| Example 1 | 140 ppm | 1 hr | 0.976 | 4 hrs |
| Example 2 | 500 ppm | 1 hr | 0.982 | 3.5 hrs |

Tables 2 and 3 below indicate the charging and fusing results for the control toner of Comparative Example 1 and the toner of Example 2. As illustrated, neither the charging nor the fusing results showed any major effect due to the addition of the defoamer.

TABLE 2

| | A-Zone | | C-Zone | |
|---|---|---|---|---|
| Toner | q/d | q/m | q/d | q/m |
| Control | 9.1 | 42 | 14.7 | 76 |
| 500 ppm Defoamer (TEGO ®FOAMEX 830) | 9.5 | 45 | 17.1 | 79 |

q/d = toner average charge distribution, where q = charge and d = diameter of particle
q/m = toner charge per mass ratio

TABLE 3

| Fusing Fixture | Control | Comparative Example 2 |
|---|---|---|
| Cold offset on DCX+ | 123 | 120 |
| Gloss at MFT on DCX+ | 29.5 | 23.8 |
| Gloss at 180° C. on DCX+ | 66.9 | 60.1 |
| Peak Gloss on DCX+ | 67.7 | 66.4 |
| T(Gloss 50) on DCX+ | 143 | 146 |
| T(Gloss 60) on DCX+ | 156 | 157 |
| $MFT_{CA-80}$ (extrapolated MFT) | 123 | 121 |
| MFT (EA1 −40° C.) XRCC −30° C. | −27 | −29 |
| Mottle/Hot Offset DCX+ 220 mm/s | 190/200 | 180/200 |
| Fusing Latitude HO-MFT on DCX+ (>50) | 77 | 79 |
| Fix ($T_{G50}$ & $MFT_{CA-80}$) | −22 | −19 |
| 24 hour @ 60° C. Document Offset (Toner-Toner/Toner-Paper) | 4.25/1.00 | 4.25/1.00 |
| 7 Day @ 60° C. Document Offset Toner-Toner/Toner-Paper | N/A | N/A |

DCX+ = paper utilized from Xerox Corporation
MFT = minimum fixing temperature
T(Gloss 50), or $T_{G50}$ = temperature at which the gloss achieved is 50 gardner gloss g units (ggu)
T(Gloss 60) or $T_{G60}$ = temperature at which the gloss achieved is 60 gardner gloss g units (ggu)
$MFT_{CA-80}$ = minimum fixing temperature with 80% toner coverage
MFT(EA1 −40° C.) = minimum fixing temperature in reference to an EA1 type toner
XRCC −30° C. = Internal value minus 30° C.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for producing toner comprising:

contacting at least one resin with at least one surfactant, an optional wax, an optional colorant, and at least one defoamer to form a primary slurry;

aggregating the at least one resin with an aggregating agent to form aggregated particles;

coalescing the aggregated particles to form toner particles; and recovering the toner particles, wherein coalescence cycle time is from about 1 minute to about 2 hours.

2. The method of claim 1, wherein the at least one resin comprises at least one amorphous resin optionally in combination with at least one crystalline resin.

3. The method of claim 1, wherein the toner particles have a size of from about 3 μm to about 25 μm.

4. The method of claim 1, wherein the toner particles have a number average geometric size distribution of from about 1.05 to about 1.55, and a volume average geometric size distribution of from about 1.05 to about 1.55.

5. The method of claim 1, wherein the at least one surfactant is selected from the group consisting of anionic surfactants, nonionic surfactants, cationic surfactants, and combinations thereof, present in an amount from about 0.01% to about 20% by weight of the resin.

6. The method of claim 1, wherein the defoamer is selected from the group consisting of ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, fumed silica, and combinations thereof.

7. The method of claim 1, wherein the defoamer is added to the primary slurry in an amount of from about 0.01% to about 10% by weight of the toner particles.

8. The method of claim 1, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof, present in an amount of from about 0.1% to about 8% by weight of the resin.

9. The method of claim 1, wherein the toner particles have a coarse content of from about 0.01% to about 10%, and a circularity of from about 0.93 to about 1.

10. A method for producing toner comprising:

contacting at least one amorphous polyester resin with at least one crystalline polyester resin, at least one surfactant, an optional wax, an optional colorant, and at least one defoamer to form a primary slurry;

aggregating the at least one amorphous polyester resin in combination with at least one crystalline polyester resin with an aggregating agent to form aggregated particles;

coalescing the aggregated particles to form toner particles; and recovering the toner particles, wherein the aggregation/coalescence time is from about 5 hours to about 15 hours.

11. The method of claim 10, wherein the toner particles have a size of from about 3 μm to about 25 μm, a number average geometric size distribution of from about 1.05 to about 1.55, and a volume average geometric size distribution of from about 1.05 to about 1.55.

12. The method of claim 10, wherein the at least one surfactant is selected from the group consisting of anionic surfactants, nonionic surfactants, cationic surfactants, and combinations thereof, present in an amount from about 0.01% to about 20% by weight of the resin.

13. The method of claim 10, wherein the defoamer is selected from the group consisting of ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, fumed silica, and combinations thereof, added to the primary slurry in an amount of from about 0.01% to about 10% by weight of the toner particles.

14. The method of claim 10, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof, present in an amount of from about 0.1% to about 8% by weight of the resin.

15. The method of claim 10, wherein the toner particles have a coarse content of from about 0.01% to about 10%, and a circularity of from about 0.93 to about 1.

16. A method for producing toner comprising:

contacting at least one amorphous polyester resin with at least one crystalline polyester resin, at least one surfactant, an optional wax, an optional colorant, and at least one defoamer selected from the group consisting of ethylene glycol, propylene glycol, diethylene glycol, triethylene glycol, dipropylene glycol, polyethylene glycol, neopentylene glycol, polypropylene glycol, glycerol, erythritol, threitol, arabitol, xylitol, ribitol, d-mannitol, sorbitol, galactitol, iditol, isomalt, maltitol, lactitol, fumed silica, and combinations thereof, in an amount of from about 0.01% to about 10% by weight to form a primary slurry;

aggregating the at least one amorphous polyester resin in combination with at least one crystalline polyester resin with an aggregating agent to form aggregated particles;

coalescing the aggregated particles to form toner particles; and recovering the toner particles, wherein coalescence cycle time is from about 1 minute to about 120 minutes.

17. The method of claim 16, wherein the toner particles have a size of from about 3 μm to about 25 μm, a number average geometric size distribution of from about 1.05 to about 1.55, and a volume average geometric size distribution of from about 1.05 to about 1.55.

18. The method of claim 16, wherein the at least one surfactant is selected from the group consisting of anionic surfactants, nonionic surfactants, cationic surfactants, and combinations thereof, present in an amount from about 0.01% to about 20% by weight of the resin.

19. The method of claim 16, wherein the toner particles have a coarse content of from about 0.01% to about 10%, and a circularity of from about 0.93 to about 1.

20. The method of claim 16, wherein aggregation/coalescence cycle time is of from about 1 minute to about 120 minutes.

* * * * *